US005419127A

United States Patent [19]

Moore, III

[11] Patent Number: 5,419,127

[45] Date of Patent: May 30, 1995

[54] INSULATED DAMPED EXHAUST MANIFOLD

[76] Inventor: Dan T. Moore, III, 2626 Fairmount Blvd., Cleveland Heights, Ohio 44106

[21] Appl. No.: 155,688

[22] Filed: Nov. 22, 1993

[51] Int. Cl.[6] ..... F01N 3/20

[52] U.S. Cl. ..... 60/322; 60/323

[58] Field of Search ..... 60/322, 323; 123/193.5; 181/231

[56] References Cited

U.S. PATENT DOCUMENTS

| | | | |
|---|---|---|---|
| 3,488,723 | 1/1970 | Veazie . | |
| 3,727,410 | 4/1973 | Scheitlin . | |
| 3,750,403 | 8/1973 | Deutschmann et al. . | |
| 3,799,796 | 3/1974 | Hunter . | |
| 4,243,093 | 1/1981 | Nieman . | |
| 4,276,331 | 6/1981 | Bothwell . | |
| 4,373,331 | 2/1983 | Santiago et al. . | |
| 4,376,374 | 3/1983 | Bothwell . | |
| 4,831,824 | 5/1989 | Fukazawa | 60/323 |
| 4,884,400 | 12/1989 | Tanaka et al. . | |
| 5,004,018 | 4/1991 | Bainbridge | 60/322 |
| 5,024,289 | 6/1991 | Merry . | |
| 5,134,846 | 4/1992 | White | 60/322 |
| 5,137,789 | 8/1992 | Kaushal . | |
| 5,150,572 | 9/1992 | Johnson et al. . | |
| 5,173,267 | 12/1992 | Maus | 60/322 |
| 5,239,956 | 8/1993 | Keelan et al. . | |
| 5,293,743 | 3/1994 | Usleman | 60/322 |

FOREIGN PATENT DOCUMENTS 58-104318 6/1983 Japan .

OTHER PUBLICATIONS

Moore, Wayne R. and Mondt, J. Robert, "Predicted Cold Start Emission Reductions Resulting from Exhaust Thermal Energy Conservation to Quicken Catalytic Converter Lightoff", SAE Technical Paper Series, Paper No. 931087, pp. 149–156, by SAE International, Warrendale, Pa. (1993).

*Primary Examiner*—Ira S. Lazarus
*Assistant Examiner*—Daniel J. O'Connor

[57] ABSTRACT

An exhaust manifold for conducting the heated exhaust gas from an internal combustion engine. The exhaust manifold has a thin noncast metal inner layer, a thicker sheet metal outer layer, and a layer of insulating material, preferably ceramic beads, between the inner and outer layers. The method of making the exhaust manifold is also disclosed. The exhaust manifold is damped, insulated, and permits quicker light off of the catalytic converter.

16 Claims, 3 Drawing Sheets

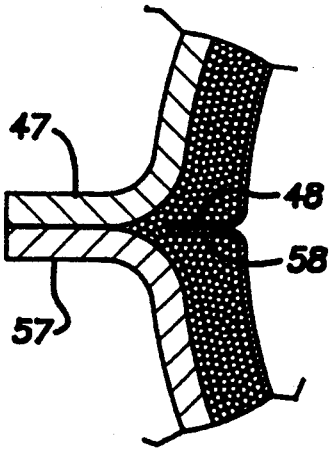
Fig.3A
Fig.3
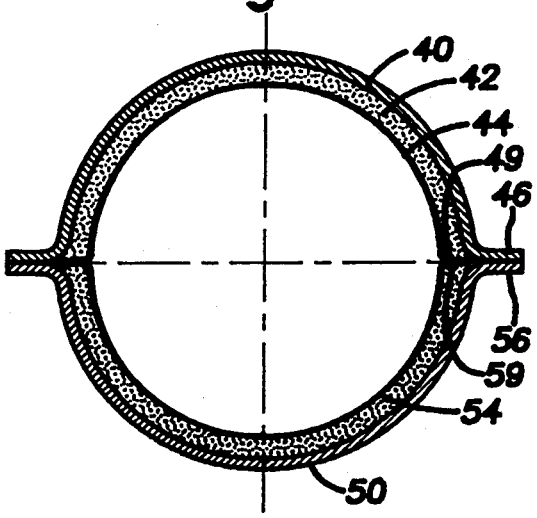
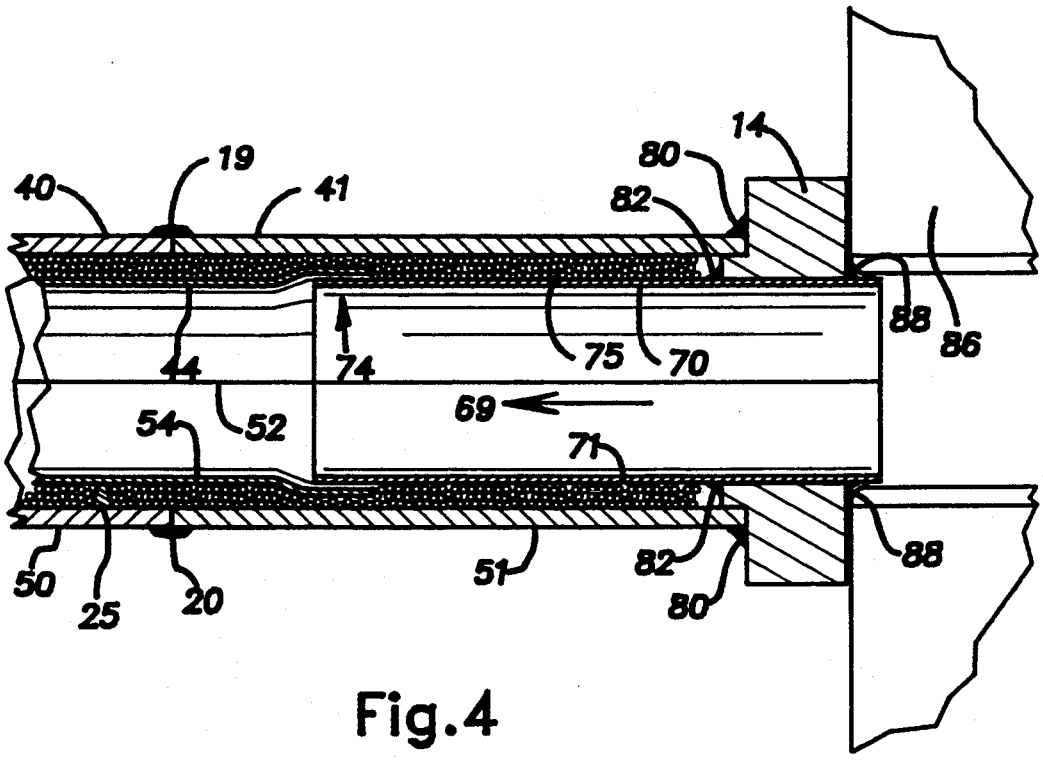
Fig.4

INSULATED DAMPED EXHAUST MANIFOLD

BACKGROUND OF THE INVENTION

This invention relates generally to the exhaust system of an internal combustion engine and more particularly to an exhaust manifold for an automobile or other motorized vehicle.

DESCRIPTION OF RELATED ART

Catalytic converters in motorized vehicles, particularly passenger automobiles, must reach a certain temperature before they "light off" or begin to oxidize carbon monoxide, hydrocarbons, and other pollutants. Catalytic converters are typically heated by the engine exhaust gases. It is important to minimize the amount of time before light off occurs after a car is started, particularly in cold weather, so as to minimize the amount of air pollution emitted by that car. Insulating the exhaust manifold will decrease or minimize the amount of heat loss during initial start up and therefore decrease the time for light off to occur, thus reducing air pollution and permitting automobiles to more easily satisfy increasingly stringent air quality standards.

In the field of internal combustion engines, it is also desirable to reduce the noise generated thereby, and, particularly with regard to motorized vehicles, it is desirable to insulate such things as plastic and electronic components from the hot exhaust system. Various heat shields and insulation have been proposed and used for these purposes.

Various techniques for insulating exhaust manifolds and/or for providing other means to speed up light off have been suggested. Cast iron exhaust manifolds are useful but heavy. Also, the mass (large thermal mass) drains heat from the exhaust gas. Welded tubing exhaust manifolds have less mass, but are complicated and expensive. Double-walled welded tubing exhaust manifolds have been suggested, with an air gap between the walls, but the two walls have the same thickness and are both structural and such an exhaust manifold would be unreasonably complex to manufacture.

It has also been suggested to provide electric heaters to assist heating exhaust gases after they exit the exhaust manifold. It has also been suggested to provide a "pup" or additional catalytic converter integrated into or near the outlet port of the exhaust manifold. However, these approaches are expensive and add weight.

SUMMARY OF THE INVENTION

An exhaust manifold for conducting heated exhaust gas from an internal combustion engine is provided. The exhaust manifold has at least one inlet and at least one outlet. The exhaust manifold has an inner layer of noncast metal which defines an exhaust gas passage and a surrounding outer layer of sheet metal. It also has means associated with the inlet for mounting the exhaust manifold to the head of an internal combustion engine. The outlet is adapted to be connected with the exhaust system. One of the layers has a first predetermined thickness, and the other of the layers has a second predetermined thickness substantially different from the first predetermined thickness so that the exhaust manifold is adapted to avoid in-phase resonance. Preferably, the inner layer is thinner than the outer layer and is spaced apart from the outer layer to form a gap therebetween, the gap being filled with insulating material, preferably ceramic beads.

It is an object of the invention to provide an insulated exhaust manifold which reduces or eliminates the need for a heat shield and which provides faster light off than conventional exhaust manifolds and reduces or eliminates the need for electric heaters and pup converters. It is a further object to provide a comparatively lightweight, effectively sound-damped exhaust manifold.

BRIEF DESCRIPTION OF THE DRAWINGS

FIG. 1 is rotated 90° around a horizontal line passing through FIG. 1).

FIG. 3 is a sectional view taken along line 3—3 of FIG. 1.

FIG. 3A is an enlarged view of an indicated portion of FIG. 3.

FIG. 4 is a sectional view taken along line 4—4 of FIG. 1.

DETAILED DESCRIPTION OF THE PREFERRED EMBODIMENTS

Figure 1:
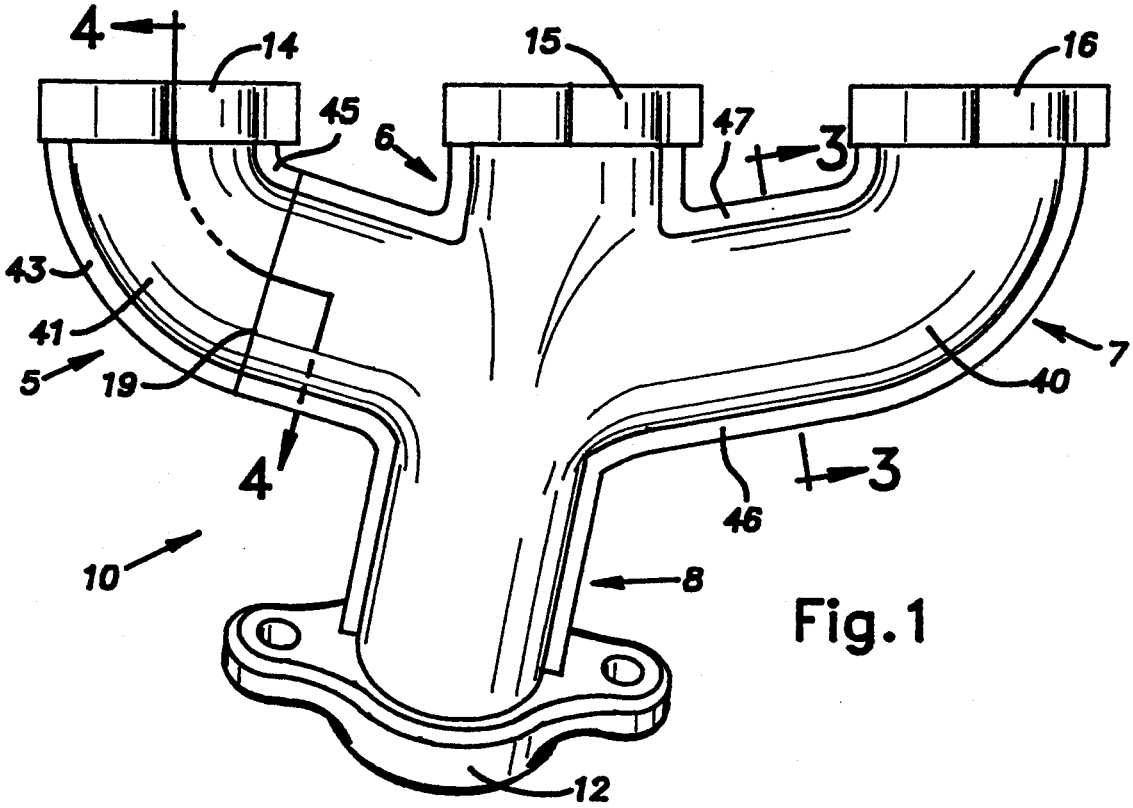
FIG. 1 is a top view of an exhaust manifold of the present invention for one side of a typical six cylinder engine.
Figure 2:
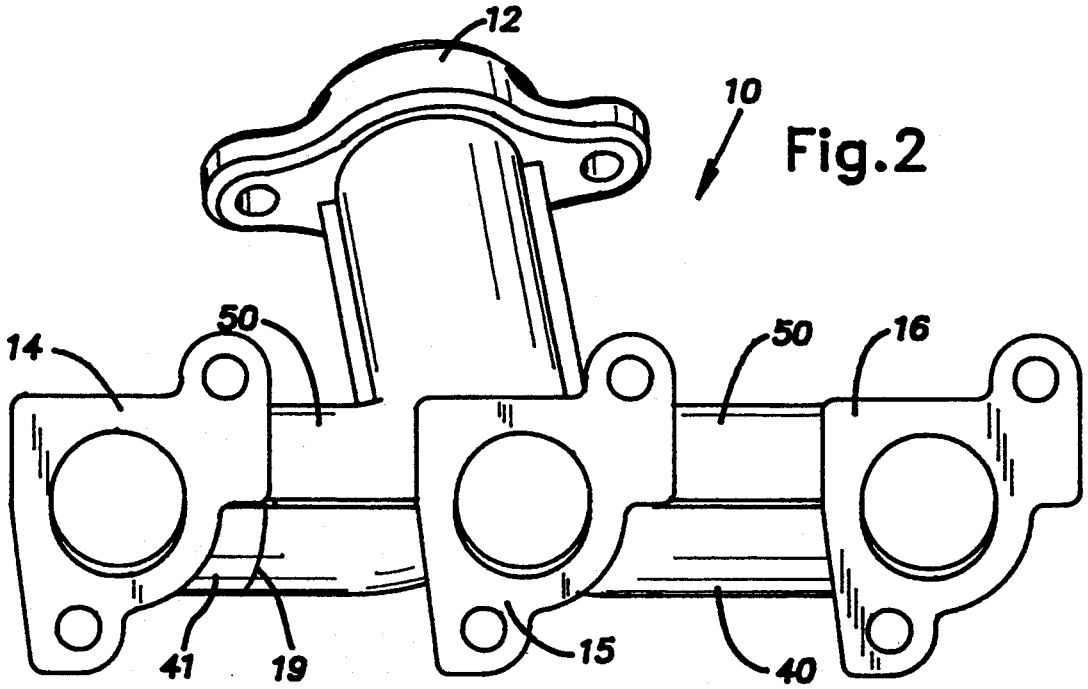
FIG. 2 is a back view of the exhaust manifold of FIG. 1. (It shows the view resulting when

With reference to FIGS. 1 and 2, there is shown an exhaust manifold 10 having inlet flanges 14, 15, and 16 and outlet flange 12, these flanges preferably made from cast iron or steel, the outer faces of the inlet flanges defining a plane of assembly for mounting to the head of the internal combustion engine. The present invention applies to other exhaust manifolds known in the art having other configurations. In use, the inlet flanges of FIG. 1 are attached to the exterior of the engine block to mount the manifold thereon and the outlet flange is attached to a take down pipe or exhaust pipe, which in turn is typically connected to other parts of the exhaust system, which includes a catalytic converter and muffler. The exhaust manifold 10 has runners or inlets 5, 6, and 7 which conduct or convey exhaust gas flow along generally parallel paths away from the engine and each of which defines an exhaust gas passage and which collect said gas flow into outlet or collector tube or tube 8. The exhaust manifold is double-walled with an insulating layer therebetween, the two walls being provided by an outer layer and an inner layer. To illustrate the double-walled, insulated structure, runner 7 is shown in cross-section in FIGS. 3 and 3A. With reference to FIGS. 1, 3 and 3A, there is shown a top outer piece 40 having peripheral flange portions 46 and 47. There is shown a bottom outer piece 50 having peripheral flange portions 56 and 57. There is shown a top inner piece 44 having peripheral flange portions 48 and 49 and a bottom inner piece 54 having peripheral flange portions 58 and 59. Between the adjacent but spaced apart inner and outer pieces is an insulating layer 42 which is continuous between the top and bottom pieces, as more specifically shown in FIG. 3A. The inner layer thus preferably "floats free" with respect to the outer layer. The inner layer is spaced apart from the outer layer over preferably at least the majority, and more preferably all, of their adjacent or mutually opposed surface areas to form a gap therebetween.

In FIG. 1, the top outer layer is provided by two top outer pieces 40 and 41, which are attached via welding or other means at joint 19. Preferably the top outer layer is a single continuous piece, but it may be necessary to make it from two or more pieces, welded or otherwise joined together due to geometry, space limitations, or other reasons. Top outer piece 41 has peripheral flange portions 43 and 45. As shown in FIG. 1, the top outer layer preferably has a flange along its entire periphery (except where the inlet and outlet flanges are attached).

As partially shown in FIG. 2, there is a bottom outer layer which corresponds to the top outer layer, the bottom outer layer having flange portions corresponding to the flange portions of the top outer layer so that the two outer layers can be welded or otherwise joined together along the flanges thereof to form an airtight exhaust manifold. The bottom outer layer, like the top outer layer, is preferably a single continuous piece, but it may be made from two or more pieces welded or otherwise joined together. In FIG. 2 there is shown bottom outer piece 50 which may constitute the entire bottom outer layer, or there could less preferably be a second bottom outer piece, obscured by inlet flange 14, corresponding to top outer piece 41.

Figure 5:
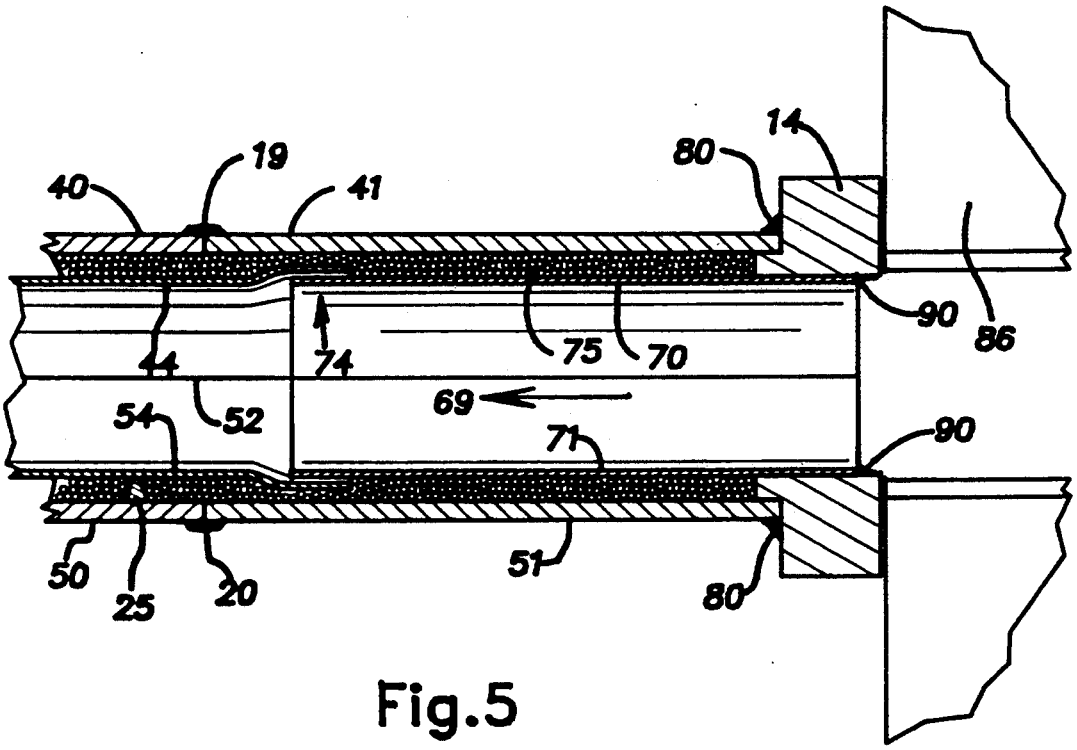
FIG. 5 is a sectional view showing an alternative embodiment of a portion of FIG. 4.

With reference to FIG. 4, there is shown flange 14 attached to engine block 86. The exhaust gases flow from the internal combustion engine into the exhaust manifold in the direction indicated by arrow 69. Runner 5 has a top outer layer comprised of top outer pieces 40 and 41 welded at joint 19, and a bottom outer layer comprised of bottom outer pieces 50 and 51 welded at joint 20. FIG. 4 further shows a top inner layer comprised of top inner pieces 44 and 70, and a bottom inner layer comprised of bottom inner pieces 54 and 71, the respective top and bottom pieces being joined at seam 52. Seams on opposite sides of a runner, tube, or other part of the manifold define a plane or surface of assembly. A slip fit expansion joint is shown at 74 whereby the end of one inner layer section, such as pieces 70 and 71 joined together, is slidably engageable with the other inner layer section, such as pieces 44 and 54 joined together, which has a flared end, in which case the inner layer or tube sections would preferably be welded at the flanges they respectively engage. Complexity of geometry may require multiple sections and additional slip-fitting expansion joints. Alternatively, and usually preferably, the top inner layer and bottom inner layer could each be a single continuous piece, eliminating the need for a slip fit expansion joint. In such an embodiment, expansion would preferably be accommodated by welding the inner layers to one or more of the inlet flanges but not the outlet flange, or welding them to the outlet flange but not to one or more of the inlet flanges, thus permitting expansion through the flange to which the part is not welded. The inner and outer layers are preferably imperforate. Insulating layer 75 is between the inner and outer layers. A small protruding bump or piece of metal is provided as standoff 25, preferably situated at a nodal point to minimize transmission of vibration. Standoffs may be provided to maintain the gap between the inner and outer layers. Preferably, standoffs are not used since some vibrational and heat energy may be transmitted through them. Preferably the outer layers are welded to the inlet flanges as shown at 80 and similarly to the outlet flange to create an airtight environment to contain the exhaust gases. When an inner layer is welded to an inlet or outlet flange, it can be via welds at 82 or 88 or both, or alternatively it can be via the arrangement shown in FIG. 5 with welds 90. The inner layer may or may not extend beyond the respective inner and outer flanges, as shown in FIGS. 4 and 5.

The top and bottom layers, both inner and outer, are preferably single sheets of metal, die-formed or stamped to generally define the concave member or half-circle type configuration with flanges shown in FIG. 3 and the other half-circles with flanges of the other runners and tubes, etc. These stampings are generally concave when viewed from the inside. It can be thought of as stamping two clamshell half-sections or pieces which compliment each other and the flanges of which mate with each other. The clamshells are subsequently joined together to define the various exhaust gas passages including runners and tubes. When the top and bottom layers, both inner and outer, are single sheets, assembly after stamping of the metal sheets is preferably as follows, with reference to FIG. 1. The two inner layers or concave members are seam welded along their flanges, preferably airtight although this is not usually necessary. Then the three inlet flanges are fitted onto the inner layer and welded (or left unwelded if expansion is to occur through the inlet flanges). The outer layers or concave members are then placed around the inner layers and seam welded along their flanges to create an airtight seam. The outer layers are then welded to the three inlet flanges airtightly. Then the insulating material, preferably ceramic beads, is poured from the outlet end into the insulating layer or gap between the inner and outer layers. Shaking or vibration may be necessary. The outlet flange is then welded to the outer layer (airtightly) and to the inner layer, see FIG. 5, or the inner layer may be unwelded to permit expansion.

If the top and bottom layers, inner and/or outer, consist of multiple pieces, such as two pieces, assembly would be similar, preferably as follows. Two inner pieces, such as 70 and 71, would be welded together to form an inner layer section or tube section. Then the other two inner pieces, such as 44 and 54, would be welded together to form a second inner layer section or tube section. Then the two inner layers or tube sections would be slip-fit together, such as at 74. Then the three inlet flanges would be attached as above. Then two outer pieces, such as 40 and 50, would be placed around the inner layer and welded together (i.e., to each other). Then the other two outer pieces, such as 41 and 51, would be placed around the inner layer and welded together. Then the two outer layers or sections would be joined together, such as by welding airtightly at joints 19 and 20. Then, as above, the outer layer would be attached to the three inlet flanges, the insulating material would be poured or placed in, and the outlet flange would be attached.

Alternatively, one or more of the inner layer sections or tube sections, such as the tube section formed by pieces 70 and 71, could be made from tubing (such as extruded or seamless tubing or seam welded tubing), which typically would be bent. Optionally the inner layer could be formed from prefabricated tubing pieces being bent and then welded together. Bending of tubing as known in the art can be done with or without an internal mandrel. Alternatively such bending can be done with polyurethane expanded to fill the interior of a tube, or pressurized fluid inside the tube, or other suitable structural support inside the tube to prevent collapse, folding, wrinkles and ridges during the bending process. Noncast metal, as used in the specification and claims, means sheet metal or tubing such as extruded or seamless tubing or seam welded tubing.

One feature of the invention is that the inner layer has a substantially different thickness from the outer layer so that the exhaust manifold will avoid in-phase resonance and produce less radiated noise than would be produced with the two layers having the same thickness. Preferably the majority or substantially all of the inner layer of the exhaust manifold has a substantially different thickness from the outer layer of the exhaust manifold. When the frequency of vibration created by engine operation or from other sources is in resonance with one layer, it will preferably not be in resonance with the other layer. Preferably the inner and outer layers will have substantially different resonant frequencies. The inner layer is preferably much thinner than the outer layer, preferably sufficiently thinner to provide effective reduction in radiated noise. The inner layer is made of steel, preferably stainless steel sheet metal of the following thicknesses, preferably high grade stainless steel such as 439 stainless steel or better, due to the extreme exhaust gas temperature typically in the range of about 1400 to about 1650° F. The inner layer is preferably between about 0.006 and about 0.024 inches thick, preferably not more than about 0.020 inches thick, more preferably between about 0.010 and about 0.020 inches thick, more preferably between about 0.015 and about 0.017 inches thick. The inside diameter of the inner layer tube obviously varies, but for the runner it is typically about 1.25 inches and for the collector tube it is typically between about 2 and about 3 inches. The gap between the inner and outer layers depends somewhat on the geometry, but is preferably uniform in width and is preferably between about 0.120 and about 0.250 inches, more preferably between about 0.150 and about 0.225 inches, more preferably between about 0.190 and about 0.210 inches and more preferably about 0.197 inches. The gap is filled with insulating material, which preferably contacts the inner and outer layers. The outer layer must be thick enough to provide structural support and is preferably not less than about 0.040 inches thick, preferably between about 0.040 and about 0.060 inches thick, more preferably between about 0.048 and about 0.052 inches thick, and even more preferably about 0.050 inches thick. The outer layer is preferably stainless steel sheet metal, grade 409 or better, of the above thicknesses. It is also believed that certain coated steels (such as hot-dipped aluminized steel, aluminum-clad steel or mild steel coated with high temperature corrosion resistant paint) able to withstand temperatures up to about 750° F. can be used for the outer layer. Less preferably, the outer layer can be cast iron or cast steel, in the clamshell shape, and welded or otherwise joined together.

The insulating material is preferably ceramic beads or spheroids able to withstand high temperatures up to about 1650° F. and having low thermal conductivity. The beads are preferably low-density, inorganic, spheroidal, and incompressible and preferably 0.5 to 6 mm, more preferably about 1 to about 2 mm, in diameter. A preferred embodiment is a mixture of 60% one mm beads and 40% two mm beads, by volume, which combines low thermal conductivity with good structural support. One function of the beads is to provide frictional damping to reduce noise, and smaller beads, such as 1 mm, are better for this function, and smaller beads tend to break less. The beads may be hollow, which are lighter and less thermally conductive, or solid, which tend to crack or break less. The beads are preferably high temperature ceramics such as silica-based ceramics and porcelain. Preferred ceramic beads are Manibeads available from Advanced Ceramics Inc., Cleveland, Ohio, preferably 1 and 2 mm solid beads although hollow and various other sizes are available. These beads are silica-based. Less preferred ceramic beads are Ceramcel beads from Microcel Technology Inc., Edison, N.J. These beads include mullite beads, porcelain beads, and alumina-based beads. Preferably they are 1.5–3 mm solid beads, although hollow and sizes up to 5 mm are available. Less preferably, the insulating material can be ceramic fiberous material or matting or high temperature woven or nonwoven fiberous material such as fiberglass or high temperature composites. Fibrous insulation would preferably be placed in the gap before the outer layer is placed thereover.

The advantages of the present invention are several. The insulation eliminates the need for a separate heat shield and retains heat for quicker light off. The ceramic beads provide frictional damping to reduce radiated noise and support the thin inner layer to prevent extreme vibration and metal fatigue. The ceramic beads transmit forces and pressures imposed on the inner layer to the outer layer so the outer layer can support the inner layer. Even if the gap is an air gap not filled with insulation, which is a possible embodiment herein, the dual-walled exhaust manifold will act as a heat shield and will give faster light off due to the thinness and lower thermal mass of the inner layer.

The fact that the outer metal layer has a similar shape to the inner layer but is several times thicker (preferably 2 to 6 times, more preferably 3 to 4 times) results in the two layers having mismatched resonant frequencies which avoids in-phase resonance and which results in radiation of less sound energy and noise. The inner layer is essentially too thin to provide structural support and accordingly is preferably nonstructural, the structural support being provided by the thicker outer layer. Nonstructural means non-load bearing. The inner layer is not designed to bear mechanical forces imposed from the outside on the exhaust manifold. The outer layer is load bearing and is designed to support the manifold and bear the mechanical forces imposed on the manifold. The thinness of the inner layer provides less thermal mass and drains less heat energy from the exhaust gases providing quicker light off. Preferably the inner layer is of sufficient thinness to provide effective reduction in the time to light off, particularly when compared with a 0.050 inches thick inner layer. The more thermally massive outer layer is insulated from the exhaust gases. The preferred stamped metal design provides a very smooth inner surface on the inner layer for more laminar and efficient gas flow (the inner layer being preferably wrinkle-free), significantly eliminates internal and external weld flash and eliminates misalignments, common problems with welded tubing exhaust manifolds. The inner and outer layers being stamped from sheet steel makes them in some respects cheaper and more convenient to make than bent and welded tubing. The quicker light off provided by the present invention eliminates the need for alternative methods to reduce emissions during initial operation of the engine, such as pup converters and electric heaters. The present exhaust manifold is minimized in volume to save space and preferably does not have an inlet port to admit ambient air to mix with exhaust gas. Less preferably, the present invention can be utilized in the construction of any other portion of the exhaust system between the engine and the catalytic converter, including exhaust pipes which receive exhaust gas from the exhaust manifold and which convey exhaust gas to the catalytic converter.

Strict state and federal laws and regulations have been and are being imposed to reduce the amount of pollution emitted from passenger automobiles, so-called Low Emissions Vehicles (LEV) and Ultra Low Emissions Vehicles (ULEV). It is believed that use of the present invention will materially assist passenger automobiles meeting LEV and ULEV emissions requirements, particularly emissions requirements during the first 30 seconds after the car is started.

Although the preferred embodiments of this invention have been shown and described, it should be understood that various modifications and rearrangements of the parts may be resorted to without departing from the scope of the invention as disclosed and claimed herein.

What is claimed is:

1. An exhaust manifold for conducting heated exhaust gas from an internal combustion engine to an exhaust system, said exhaust manifold having at least one inlet and at least one outlet, said exhaust manifold comprising an inner layer of noncast metal which defines an exhaust gas passage and a surrounding outer layer of sheet metal and having means associated with said inlet for mounting said exhaust manifold to the head of an internal combustion engine, said outlet being adapted to be connected with said exhaust system, one of said layers having a first predetermined thickness and the other of said layers having a second predetermined thickness substantially different from said first predetermined thickness so that said exhaust manifold is adapted to avoid in-phase resonance, said inner layer being between about 0.006 and about 0.024 inches thick, said inner layer being spaced apart from said outer layer over at least the majority of their adjacent surface areas to form a gap therebetween, and a layer of ceramic beads in said gap.

2. An exhaust manifold according to claim 1, said inner layer comprised of a first concave member and a second concave member, said first and second concave members being sheet metal and having peripheral flanges, said first and second concave members being attached to each other at their respective flanges to define said exhaust gas passage, said outer layer comprised of a third concave member and a fourth concave member, said third and fourth concave members having peripheral flanges, said third and fourth concave members being attached to each other at their respective flanges.

3. An exhaust manifold according to claim 1, said exhaust manifold having a plurality of inlets, said inner layer being substantially imperforate.

4. An exhaust manifold according to claim 2, said outer layer being not less than about 0.040 inches thick, said inner layer being not more than about 0.020 inches thick, said gap being between about 0.120 and about 0.250 inches thick, said gap being filled with spheroidal ceramic beads.

5. An exhaust manifold according to claim 1, wherein said inner layer comprises at least two inner layer sections which are slidably engaged with each other at a slip-fitting expansion joint., said slip-fitting expansion joint being adapted to accommodate expected longitudinal expansion and contraction of said inner layer sections independent of longitudinal expansion and contraction of said outer layer.

6. An exhaust manifold according to claim 2, said peripheral flanges of said first and second concave members being spaced apart from said outer layer to permit the peripheral flanges of said first and second concave members to expand and contract longitudinally independent of longitudinal expansion and contraction of the peripheral flanges of said third and fourth concave members.

7. An exhaust manifold according to claim 1, wherein said inner layer is stainless steel and said outer layer is steel.

8. An exhaust manifold according to claim 1, wherein said inner layer is between about 0.010 and about 0.020 inches thick.

9. An exhaust manifold according to claim 8, wherein said inner layer does not exceed about 0.017 inches thick.

10. An exhaust manifold according to claim 1, wherein said outer layer is 2 to 6 times thicker than said inner layer and said layers have mismatched resonant frequencies.

11. An exhaust manifold according to claim 7, wherein said inner layer is between about 0.010 and about 0.020 inches thick and said outer layer is between about 0.040 and about 0.060 inches thick.

12. An exhaust manifold according to claim 1, wherein said inner layer is adapted such that it may expand and contract longitudinally independent of longitudinal expansion and contraction of said outer layer.

13. An exhaust manifold according to claim 1, wherein said ceramic beads are 1.5 to 3 mm in diameter.

14. A method of fabricating an exhaust manifold, said exhaust manifold having at least one inlet and at least one outlet, said method comprising the steps of forming from sheet metal a first concave member, a second concave member, a third concave member, and a fourth concave member;

attaching said first and second concave members to each other to provide an inner layer which defines an exhaust gas passage, said inner layer being between about 0.006 and about 0.024 inches thick;

providing an outer layer surrounding said inner layer, said outer layer being comprised of said third and fourth concave members attached to each other, one of said layers having a first predetermined thickness and the other of said layers having a second predetermined thickness substantially different from said first predetermined thickness so that said exhaust manifold is adapted to avoid in-phase resonance;

providing a gap between said inner layer and said outer layer over at least the majority of their adjacent surface areas; and providing a layer of ceramic beads in said gap.

15. A method according to claim 14, further comprising forming said firs, second, third, and fourth concave members by stamping, providing said first, second, third, and fourth concave members with peripheral flanges, attaching said first and second concave members to each other by welding together their respective flanges, and attaching said third and fourth concave members to each other by welding together their respective flanges.

16. A method according to claim 15, further comprising fixing said peripheral flanges of said first and second concave members in spaced apart relationship from said outer layer.

* * * * *

UNITED STATES PATENT AND TRADEMARK OFFICE

CERTIFICATE OF CORRECTION

PATENT NO. : 5,419,127

DATED : May 30, 1995

INVENTOR(S) : Dan T. Moore, III

It is certified that error appears in the above-indentified patent and that said Letters Patent is hereby corrected as shown below:

Title page , between the line for "Inventor" and the line for "Appl. No." insert the following line -- 73 Assignee: Soundwich, Inc., Cleveland, Ohio--.

Column 7, line 57, delete "claim 2," and insert therefor --claim 1,--.

Column 7, line 66, delete "joint.," and insert therefor --joint,--.

Column 8, line 56, delete "firs," and insert therefor --first,--.

Title page , before the Abstract, add the following line --Attorney, Agent or Firm—Pearne, Gordon, McCoy & Granger--.

Signed and Sealed this

Twelfth Day of March, 1996

Bruce Lehman

*Attest:*

BRUCE LEHMAN

*Attesting Officer*

*Commissioner of Patents and Trademarks*